US008206209B1

(12) United States Patent
Fox

(10) Patent No.: US 8,206,209 B1
(45) Date of Patent: Jun. 26, 2012

(54) GAMING MACHINE BONUS SYSTEM

(76) Inventor: John Fox, Omaha, NE (US)

( * ) Notice: Subject to any disclaimer, the term of this patent is extended or adjusted under 35 U.S.C. 154(b) by 1562 days.

(21) Appl. No.: 11/342,410

(22) Filed: Jan. 30, 2006

(51) Int. Cl.
*A63F 9/24* (2006.01)

(52) U.S. Cl. ..... 463/20; 463/16

(58) Field of Classification Search ..... 463/16, 463/20

See application file for complete search history.

(56) References Cited

U.S. PATENT DOCUMENTS

| | | | | |
|---|---|---|---|---|
| 4,095,795 | A | 6/1978 | Saxton et al. | |
| 4,184,683 | A | 1/1980 | Hooker | |
| 4,448,419 | A | 5/1984 | Telnaes | |
| 4,711,451 | A | 12/1987 | Pajak et al. | |
| 6,217,448 | B1 | 4/2001 | Olsen | |
| 6,231,445 | B1 | 5/2001 | Acres | |
| 6,270,412 | B1 | 8/2001 | Crawford et al. | |
| 7,032,901 | B2 * | 4/2006 | Perrie et al. | 273/138.1 |
| 7,294,058 | B1 * | 11/2007 | Slomiany et al. | 463/31 |
| 2003/0078091 | A1 | 4/2003 | Brandstetter et al. | |
| 2006/0068885 | A1 * | 3/2006 | Cregan et al. | 463/20 |
| 2007/0254734 | A1 * | 11/2007 | Gilmore et al. | 463/20 |
| 2007/0259714 | A1 * | 11/2007 | Block et al. | 463/29 |

* cited by examiner

*Primary Examiner* — Masud Ahmed

(74) *Attorney, Agent, or Firm* — Caesar, Rivise, Bernstein, Cohen & Pokotilow, Ltd.

(57) ABSTRACT

A method of conducting a wagering game includes indicating a random outcome by displaying selected game symbols, initiating a first bonus at a preselected number of plays, providing a first award of a first desired number of credits, initiating a second bonus at a first multiple of the preselected number of plays, wherein the first multiple is a number greater than 1, providing a second award of a second desired number of credits, wherein the second desired number of credits is the product of the first desired number of credits times the first multiple, initiating a third bonus at a second multiple of the preselected number of plays, wherein the second multiple is a number greater than 1, and providing a third award of a third desired number of credits, wherein the third desired number of credits is the product of the first desired number of credits times the second multiple.

23 Claims, 2 Drawing Sheets

GAMING MACHINE BONUS SYSTEM

BACKGROUND OF THE INVENTION

This invention relates to the field of gaming or gambling, and, in particular, to gaming devices.

Gambling or gaming devices have been in use for decades and were originally introduced in the 19th century. A major advancement in technology of gaming devices occurred when microprocessors were introduced in the gaming or gambling field. They were divided into two major segments in their development. One being the mechanical spinning reels and the other being the use of "CRT" displays or animated displays of reels, cards, keno boards, and "21" games. The emergence of such microprocessor devices has opened a vast set of possibilities to gambling device designers. In U.S. Pat. No. 4,095,795, the first microprocessor slot machine is described.

Another major advancement used microprocessors and a software program to adjust the odds of achieving any particular combination or game outcome. For example, U.S. Pat. No. 4,448,419 describes a mechanical reel slot machine controlled by a microprocessor. The software program allowed for the control of the reels and the varying of odds of achieving any particular combination of symbols. Similarly, U.S. Pat. No. 4,711,451 describes a gambling device using mechanical reels but is controlled by a microprocessor.

Microprocessors along with the lowering prices of color monitors allowed the expansion of the second largest area of gambling devices. These devices, known as "Video Games" included video slots, 21, bingo, keno, and poker machines.

Development of use of microprocessors in the gaming or gambling fields can be divided into two major segments, first, in mechanical spinning reels and, second, in the use of CRTs, for example, in use of animated displays of reels, cards, keno boards, "21" games, and the like. The emergence of such microprocessor devices has opened a vast set of possibilities to gaming device designers. One such innovation has been to interconnect banks of machines, both locally and over broad geographic areas, with a small percentage of each wager being cumulatively added to a centralized, ever-growing, jackpot. One such arrangement is known as a multi-linked progressive jackpot. Another major advancement using microprocessors involved the use of software to adjust the odds of achieving any particular combination or game outcome.

In using microprocessors, a random number generator picks numbers representing stop positions, with each physical stop position represented by multiple software stop positions. This was the first use of the "Virtual Reel" type slot machine. This method allowed the standard 20-stop reel to be expanded up to, for example, 512 software stops. Thus, the size of the symbols used on the physical reel could remain the same size while increasing the number used on each reel. Before using microprocessors, when the number of stops on a reel increased, the symbol's physical size had to decrease because of limitations of the mechanical reel. A method of reel mapping permitted a single machine to act as a single machine, a "multiple stop" machine, or a virtual reel gambling device, thus saving on development costs. Stepper motors now replaced the mechanical reels that had been used for the past eight decades. This innovation allowed designers to have the reels spin in any direction, add reels inside of reels, and expand the number of symbols used on each reel.

Because virtual reel slot machines obscure the true probability of achieving certain combinations, players tend to choose slot machines according to the size of the jackpots offered without an appreciation of the true probability of hitting a large jackpot. For example, the odds of achieving a giant jackpot in one machine, where the jackpot may be, for example, in the tens of millions of dollars, may be very low. However, to the player, the odds do not seem to be any lower than that for obtaining any other symbol combination. In other words, in virtual reel slot machines, high jackpots may be offered which have a very low probability of being achieved, but the player is often essentially unaware of the true odds of the device.

In many locations, governmental regulations govern the minimum overall payouts and the cycle size for slot machines because the use of microprocessor technology has permitted the design of slot devices having virtual reels and bonus games, which deprive the player the knowledge of the true odds of a particular symbol appearing on the "win line" on each game. As indicated above, early mechanical slot machines had a finite number of symbols on each reel (usually 20 to 25) and the odds of each symbol appearing was relatively easily discernible.

Gaming devices generally generate revenue in accordance with the following equation:

$$\text{REVENUE}=\text{HOUSE EDGE}\times\text{HOURS PLAYED}\times\text{PLAYS PER HOUR}$$

Of the above variables, two, Hours Played and Plays Per Hour, are directly controlled by the player, and are thus difficult for a casino to change. House Edge, is directly controlled by a casino but is nonetheless difficult to change for regulatory reasons. In addition, increasing the House Edge can affect other variables to actually decrease revenue, as is described below.

Players are primarily concerned with finding a gaming device with a low "House Edge," also known as "hold percentage." This is the average percentage of wagered money which is kept by the gaming device per game. Likewise, players are primarily concerned with finding a gaming device with a high "payout percentage." The payout percentage is 100% minus the House Edge, which equals the average percentage of wagered money which is returned to a player per game. Low hold percentages (i.e., high payout percentages) are a significant factor in attracting players to one casino rather than another. Accordingly, many casinos advertise that they have gaming devices with very high payout percentages. Although a high payout percentage (low House Edge) may attract players, it also results in lower revenue. Casinos, of course, would prefer higher revenue, and may increase the House Edge to increase revenue. Paradoxically, increasing the House Edge does not always increase revenue. The House Edges of gaming devices are often displayed in publications or on the gaming device itself. Many players will avoid gaming devices that they believe to have low payout percentages, or high House Edges. Thus, if the House Edge is increased on certain gaming devices, the Hours Played or Plays Per Hour on those gaming devices may decrease, and revenues may likewise decrease.

In addition, when a casino wants to adjust the hold percentage of a slot machine, state and/or local regulations may require that the machine be removed from the casino floor, adjusted accordingly, then reactivated. Accordingly, some casinos may be reluctant to increase the House Edge of gaming devices in an attempt to increase revenues from those devices.

Increasing the Hours Played is difficult to achieve because a casino cannot easily modify player behavior. For example, to increase the Hours Played, casinos typically remove clocks from the view of players, make the seats and playing area more comfortable, and serve free drinks in an attempt to modify player behavior. Additionally, the gaming devices themselves have become increasingly more entertaining in order to entice the player to play longer. Such measures may increase the Hours Played to a certain extent, but do not necessarily increase the Hours Played significantly or at all. Increasing the Plays Per Hour (speed of game play) is likewise difficult. Efforts to increase this factor include providing a spin button, rather than a handle, on some slot machines, allowing the player to initiate each game quickly. In addition, some slot machines have faster stopping reels, which end each game more quickly. Furthermore, a group of gaming machines may be in communication over a network, allowing each of a group of players to influence the movement of an object in a race, such as a horse race or car race. Such a racing game may make some players play faster than they would have. However, other players view such a game as annoyingly complicated and do not participate.

Casinos may also sponsor tournaments, in which the first player to win a jackpot or reach a certain score wins a prize. Casinos may also organize player clubs, in which players receive points for the number of plays or amounts wagered. Such points can be redeemed for goods and services once the player has reached a certain threshold. Casinos may also offer players the chance to win a "progressive jackpot", which increases over time and is typically available to all players in a casino playing slot machines. When a progressive jackpot reaches a large dollar amount, players typically play rapidly in an attempt to win that jackpot. Since each player knows that all other players have a chance to win, they play faster in an attempt to increase their chances of winning the jackpot. However, other players are not attracted by such casino promotions, and their playing behavior is thus unaffected by the promotions.

In summary, it would be advantageous to increase a player's attraction to a gaming device.

One concept which has been successfully employed to enhance the entertainment value of a game is the concept of bonus prizes or games that are awarded in conjunction with a basic game. The bonus game may comprise a specific award in credits or cash or any type of bonus game, either similar to or completely different from the basic game, which is entered upon the occurrence of a selected event or outcome of the basic game. For example, the basic game may be a reel-type slot machine and the bonus game may be a simulated reel-type slot machine implemented on a display. The bonus game is entered upon the appearance of a special symbol combination on the reels of the slot machine in the basic game. For example, in the bonus game, the probability of winning combinations appearing on the reels, or the "hit rate," may be much greater than that of the basic game. Such a bonus game produces a significantly higher level of player excitement than the basic game because it provides a greater expectation of winning than the basic game and is accompanied with more attractive or unusual video displays and/or audio.

Because the bonus game concept offers tremendous advantages in player appeal and excitement relative to other known games, and because such games are attractive to both players and operators, there is a continuing need to develop new types of bonus games to satisfy the demands of players and operators. Preferably, such new bonus games will maintain the level of player excitement offered by bonus games heretofore known in the art. The present invention is directed to satisfying these needs.

All references cited herein are incorporated herein by reference in their entireties.

BRIEF SUMMARY OF THE INVENTION

A method of conducting a wagering game is provided which includes conducting a basic game having a randomly selected outcome that is indicated by displaying selected ones of a plurality of basic-game symbols, initiating a first bonus at a preselected number of plays, providing a first award of a first desired number of credits, initiating a second bonus at a first multiple of the preselected number of plays, wherein the first multiple is a number greater than 1, providing a second award of a second desired number of credits, wherein the second desired number of credits is the product of the first desired number of credits times the first multiple, initiating a third bonus at a second multiple of the preselected number of plays, wherein the second multiple is a number greater than 1, and providing a third award of a third desired number of credits, wherein the third desired number of credits is the product of the first desired number of credits times the second multiple. Additional awards may be awarded at proportionally increased numbers of plays and having proportionally increased award amounts.

Each of the first multiple and the second multiple may be prime numbers greater than 1. Preferably, the gaming machine is a video gaming system such as slots, keno, poker, blackjack or bingo.

In an alternate embodiment of the present invention, a method of conducting a wagering game is provided which includes conducting a basic game having a randomly selected outcome that is indicated by displaying selected ones of a plurality of basic-game symbols, initiating a first bonus at a preselected number of plays, providing a first award of a first desired number of credits, initiating a second bonus at two times the preselected number of plays, providing a second award of double the first desired number of credits, initiating a third bonus at three times the preselected number of plays, and providing a third award of a third desired number of credits, wherein the third desired number of credits is triple the first desired number of credits. More bonuses may be initiated with proportionally increased numbers of plays and having proportionally higher awards.

In another alternate embodiment of the present invention, a method of conducting a wagering game is provided which includes conducting a basic game having a randomly selected outcome that is indicated by displaying selected ones of a plurality of basic-game symbols, initiating a first bonus game at a preselected number of plays, providing a first award of a first desired number of credits upon winning the bonus game, initiating a second bonus game at a first multiple of the preselected number of plays, wherein the first multiple is a number greater than 1, providing a second award of a second desired number of credits upon winning the second bonus game, wherein the second desired number of credits is the product of the first desired number of credits times the first multiple, initiating a third bonus game at a second multiple of the preselected number of plays, wherein the second multiple is a number greater than 1, and providing a third award of a third desired number of credits upon winning the third bonus game, wherein the third desired number of credits is the product of the first desired number of credits times the second multiple. Again, more bonuses may be initiated with proportionally increased numbers of plays and having proportionally higher awards. Each of the first multiple and the second multiple may be prime numbers greater than 1.

In another alternate embodiment of the present invention, a method of conducting a wagering game is provided which includes conducting a basic game having a randomly selected outcome that is indicated by displaying selected ones of a plurality of basic-game symbols, initiating a first bonus game at a preselected number of plays, providing a first award of a first desired number of credits upon winning the first bonus game, initiating a second bonus game at two times the preselected number of plays, providing a second award of double the first desired number of credits upon winning the second bonus game, initiating a third bonus game at three times the preselected number of plays, and providing a third award of three times the first desired number of credits upon winning the third bonus game.

In another embodiment of the present invention, a method of conducting a wagering game is provided which includes conducting a basic game having a randomly selected outcome that is indicated by displaying selected ones of a plurality of basic-game symbols, initiating a first bonus upon obtaining a combination of symbols that have odds of occurring at a preselected number of plays, providing a first award of a first desired number of credits, initiating a second bonus upon obtaining a combination of symbols that have odds of occurring at a first multiple of the preselected number of plays, wherein the first multiple is a number greater than 1, providing a second award of a second desired number of credits, wherein the second desired number of credits is the product of the first desired number of credits times the first multiple, initiating a third bonus upon obtaining a combination of symbols that have odds of occurring at a second multiple of the preselected number of plays, wherein the second multiple is a number greater than 1, and providing a third award of a third desired number of credits, wherein the third desired number of credits is the product of the first desired number of credits times the second multiple Each of the first multiple and the second multiple may be prime numbers greater than 1.

In yet another embodiment of the present invention, a method of conducting a wagering game is also provided that includes conducting a basic game having a randomly selected outcome that is indicated by displaying selected ones of a plurality of basic-game symbols, initiating a first bonus game upon obtaining a combination of symbols that have odds of occurring at a preselected number of plays at a preselected number of plays, providing a first award of a first desired number of credits upon winning the bonus game, initiating a second bonus game upon obtaining a combination of symbols that have odds of occurring at a first multiple of the preselected number of plays, wherein the first multiple is a number greater than 1, providing a second award of a second desired number of credits upon winning the second bonus game, wherein the second desired number of credits is the product of the first desired number of credits times the first multiple, initiating a third bonus game upon obtaining a combination of symbols that have odds of occurring at a second multiple of the preselected number of plays, wherein the second multiple is a number greater than 1, and providing a third award of a third desired number of credits upon winning the third bonus game, wherein the third desired number of credits is the product of the first desired number of credits times the second multiple. Preferably, each of the first multiple and the second multiple are prime numbers greater than 1.

Finally, in another embodiment of the present invention, a method of conducting a wagering game is provided which includes conducting a basic game having a randomly selected outcome that is indicated by displaying selected ones of a plurality of basic-game symbols, initiating a first bonus game upon obtaining a combination of symbols that have odds of occurring at a preselected number of plays, providing a first award of a first desired number of credits upon winning the first bonus game, initiating a second bonus game upon obtaining a combination of symbols that have odds of occurring at two times the preselected number of plays, providing a second award of double the first desired number of credits upon winning the second bonus game, initiating a third bonus game upon obtaining a combination of symbols that have odds of occurring at three times the preselected number of plays, and providing a third award of three times the first desired number of credits upon winning the third bonus game.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

The present invention is directed to increasing the Plays Per Hour, as described above, of a gaming device, and thereby significantly increase the revenue to the owner of the gaming device. Players typically do not consider the number of games played on a machine, but instead attempt to find a gaming device with a low House Edge, as described above, that is easy to play. Additionally, players often are not specifically aware of the passage of time when playing on a gaming machine, so long as the player perceives that he or she is successful. Accordingly, a gaming device that is played where a bonus round occurs with less frequency as time moves forward, but with greater awards the longer a player plays will typically not discourage players, and can thus generate more revenue by providing an incentive to play faster and for longer periods of time. Such a gaming device may be played for more games so that more revenue will be generated than, for example, a higher payout percentage will create. By offering an incentive to play more games, a gaming device will typically be played for more games over a period of time than those devices that do not provide such an incentive. The casino can in turn derive greater revenue from the gaming device.

In a typical reel-type slot machine, a payout of coins or credits is made to a player whenever certain combinations of symbols are displayed on the reels relative to a payline. To accommodate various players, each machine will accept a certain minimum wager amount per activation of the reels. For example, a player willing to bet larger amounts will chose a machine having $1.00 or $5.00 as its minimum wager amount instead of a $0.05 or $0.25 machine. Also, casino operators will adjust the total game payout percentage up or down based on the profitability that the operator of the gaming machine desires and whatever regulations are imposed upon the operator by the gaming authority that regulates the use of the gaming machine. Generally, the operator will set the payout percentage for each machine based on the minimum wager amount such that the payout percentages increase as the minimum wager amount increases. For example, the payout percentage of a five dollar machine will be higher than that of a nickel machine.

Generally, the popularity of such gaming machines with players is dependent on the intrinsic entertainment value of the machine relative to other available gaming options and the likelihood (or perceived likelihood) of winning money at the machine. One concept, which has been successfully employed to enhance the entertainment value of a game, is the concept of a secondary or bonus award or game, which may be played in conjunction with a basic game. The bonus game may comprise any type of game, either similar to or completely different from the basic game, which is entered upon the occurrence of a selected event or outcome of the basic game.

Figure 1:
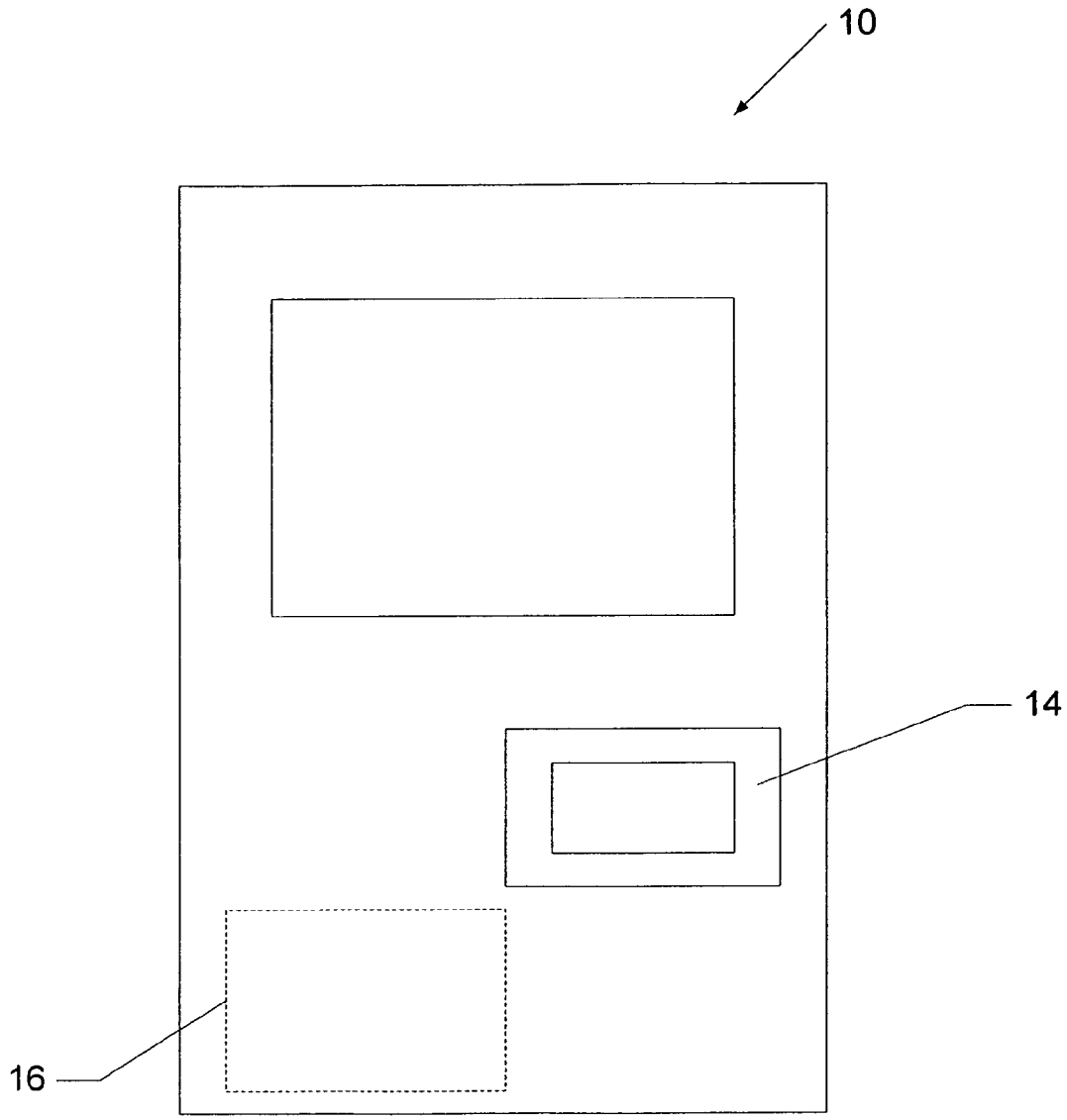
FIG. 1 is a simplified drawing of a gaming machine in accordance with one preferred embodiment of the present invention.

Referring now to the drawing, there is shown in FIG. 1 a simplified schematic drawing of a gaming machine 10 in accordance with one preferred embodiment of the present invention. The gaming machine 10 includes a video display 12, an input device 14 (or devices) for receipt of credits, for example, in the form of currency, token, card, biometric and the like, as well known in the art of gaming machines. The gaming machine 10 further includes a central processor 16 adapted to display on the video display 12 at least one game. The central processor 16 has an associated first pay table and associated with a first bet amount. The central processor 16 is capable of changing to at least one additional pay table associated with a respective additional bet amount.

Figure 2:
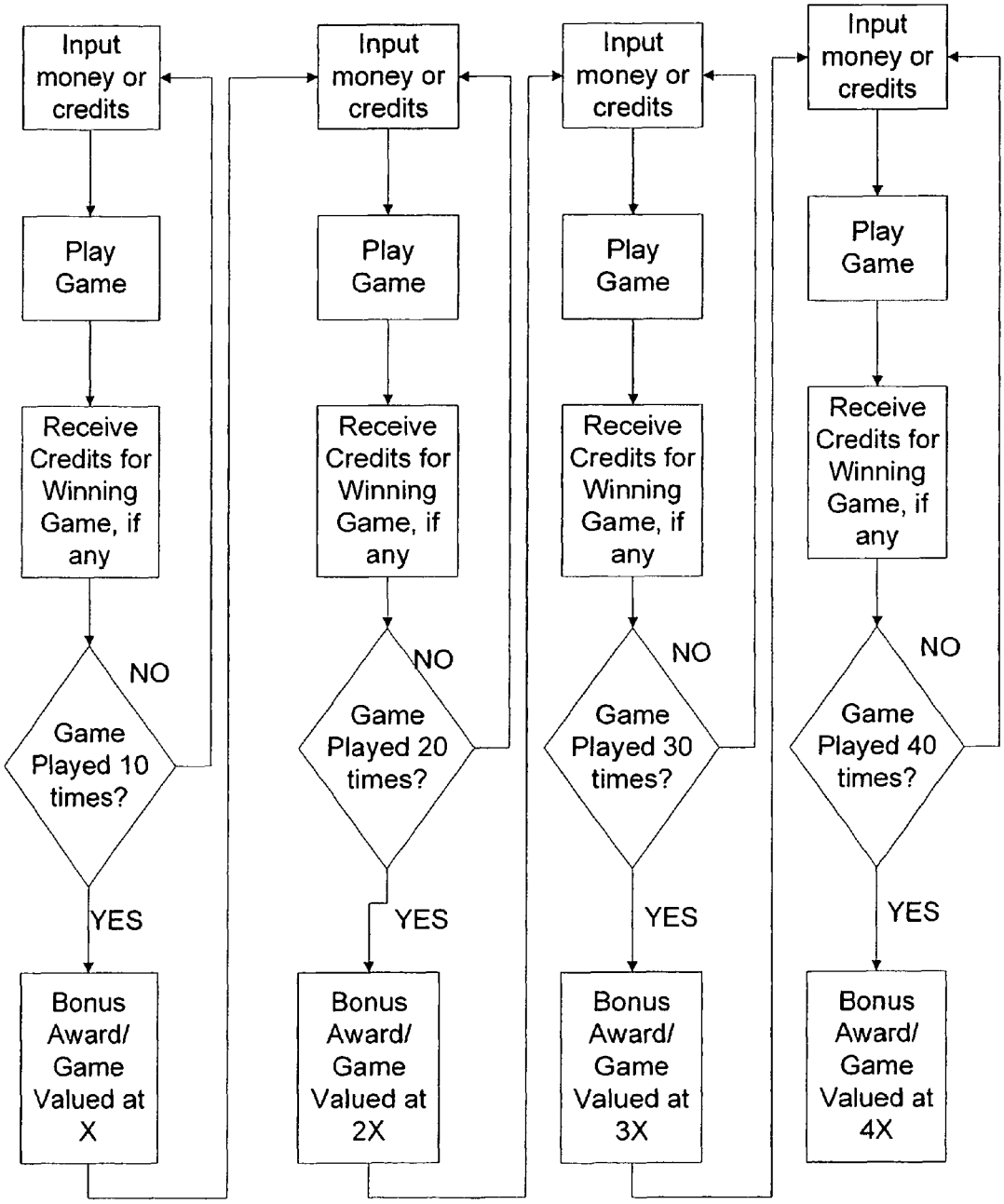
FIG. 2 is a flowchart of an example of a method of conducting a wagering game in accordance with a preferred embodiment of the present invention.

As can be seen in FIG. 2, there is shown an example of a method of conducting a wagering game in accordance with the present invention. It is noted that FIG. 2 only shows an example of the method with arbitrary numbers inserted. As will be explained below, these numbers may be varied. The method of conducting wagering game as specifically shown in FIG. 2 is as follows. On a gaming machine 10, such as a video poker, keno, bingo, blackjack or slot machine, a basic game is played having a randomly selected outcome. The outcome is displayed on the video display 12 using a plurality of basic-game symbols such as cards, fruit symbols and the like as are well known and commonly seen on video gaming machines. Bonus games and awards for such machines are also very well known. For example, if a player achieves a certain set of symbols, a bonus game may be initiated that is similar to the game the player has been playing or is entirely different, but still appears on the video display. The present invention is directed to a new type of initiator or "trigger" for the bonus round or award. Alternatively, rather than initiating a bonus game, a bonus award of, for example, a specific number of credits, may be awarded.

In the present invention, the bonus round or award is triggered after a preselected number of plays. The example of FIG. 2 shows that a bonus award is triggered for the first time after the player inserts money or otherwise applies credits to the machine ten times. After the player plays ten times, the bonus round or award is initiated. An award of a specific number of credits (X credits), for example, 10 credits is then awarded to the player. Alternatively, a bonus game may be initiated that has a potential winning value of ten credits. After the bonus game is over or the bonus award is given to the player, if the player keeps playing, the player must play double the number of times (20 times) in order for the bonus game or bonus award to be initiated. However, the bonus award (or the bonus game value) is now double (2 times X credits=2× credits). While it took longer for the player to reach the second bonus award/game, the reward is substantially greater.

In this example, the game proceeds in this manner with a third bonus game or bonus award that occurs after 30 more plays, but the bonus award or bonus game has the increased value of 3× credits. The longer the player plays, the longer it takes to achieve a bonus game or bonus award. For example, after 40 more plays, the bonus award has an increased value of 4× credits; after another 50 plays, the bonus game or bonus award has an increased value of 5× credits, etc.

Obviously, it is not the intention of the present invention to be limited to the specific numerical values stated in the above example. More generally, a first bonus award or game may be initiated at a preselected number of plays. A first award of a first desired number of credits may be awarded. A second bonus game or award is then initiated at two times the preselected number of plays. A second award is provided that is double the first desired number of credits. A third bonus game or bonus award is then initiated at three times the preselected number of plays. Here, a third award of a third desired number of credits is provided, wherein the third desired number of credits is triple the first desired number of credits.

Even more generally, the present invention provides a method of conducting a wagering game which includes the steps of conducting a basic game having a randomly selected outcome that is indicated by displaying selected ones of a plurality of basic-game symbols. A first bonus (award or game) is initiated at a preselected number of plays. A first award of a first desired number of credits is then provided to the player. A second bonus is initiated at a first multiple of the preselected number of plays, wherein the first multiple is a number greater than 1. A second award of a second desired number of credits is then provided, wherein the second desired number of credits is the product of the first desired number of credits times the first multiple. A third bonus at a second multiple of the preselected number of plays is then provided, wherein the second multiple is a number greater than 1. A third award of a third desired number of credits is then provided, wherein the third desired number of credits is the product of the first desired number of credits times the second multiple. While it is not required, each of the first multiple and the second multiple may be prime numbers. Fourth, fifth and more bonus awards and games may be initiated with correspondingly increased award amounts.

For purposes of the present invention, as discussed above, a "bonus" may be either an award of, for example, credits, or it may initiate a bonus game. The bonus game may be a single game or a predetermined series of wagered games. The bonus may effectively increase the payout percentage, but also may require a higher bet amount. Generally, any type of bonus game may be used here.

In a variation of the present invention, rather than operating strictly on a preselected number of plays to trigger a first bonus, second bonus, etc, this embodiment may operate by a user achieving a winning combination that has an expected value that is generally equal to the preselected number of plays. For example, a first bonus may be awarded or initiated when two cherries are received in a common slot type machine. Here, two cherries would be programmed to occur at approximately one out of one hundred spins. The bonus would have a value of a first desired number of credits. Once the first bonus is awarded or initiated, three oranges would trigger the second bonus round where three oranges are programmed to occur at approximately one out of two hundred spins where the bonus would have a value of two times the above desired number of credits. Once the third bonus is awarded or initiated, three bars would trigger the third bonus round where three bars are programmed to occur at approximately one out of three hundred spins where the bonus would have a value of three times the above desired number of credits. Additional plays would trigger additional bonuses at correspondingly higher numbers of spins with correspondingly higher bonuses.

Similarly, in an example of a BINGO game, a first bonus may be awarded or initiated when two corners are obtained. Here, two corners would occur at approximately one out of one hundred spins. The bonus would have a value of a first desired number of credits. Once the first bonus is awarded or initiated, for example, four corners would trigger the second bonus round where four corners are programmed to occur at approximately one out of two hundred spins where the bonus would have a value of two times the above desired number of credits. Once the third bonus is awarded or initiated, four corners plus the center square would trigger the third bonus round where four corners plus the center square are programmed to occur at approximately one out of three hundred spins where the bonus would have a value of three times the above desired number of credits. Additional plays would trigger additional bonuses at correspondingly higher numbers of spins with correspondingly higher bonuses.

Of course, these last two paragraphs are merely examples and it is not intended to limit the invention to these particular examples.

While the present invention has been described as applied to use as a video game, the present invention is also intended to operate satisfactorily on any other type of game such as games having mechanical spinning wheels.

While the invention has been described in detail and with reference to specific examples thereof, it will be apparent to one skilled in the art that various changes and modifications can be made therein without departing from the spirit and scope thereof.

What is claimed is:

1. A method of conducting a wagering game, comprising:
(A) conducting a basic game having a randomly selected outcome that is indicated by displaying selected ones of a plurality of basic-game symbols;
(B) initiating a first bonus at a preselected number of plays;
(C) providing a first award of a first desired number of credits;
(D) initiating a second bonus at a first multiple of the preselected number of plays, wherein the first multiple is a number greater than 1;
(E) providing a second award of a second desired number of credits, wherein the second desired number of credits is the product of the first desired number of credits times the first multiple;
(F) initiating a third bonus at a second multiple of the preselected number of plays, wherein the second multiple is a number greater than 1; and
(G) providing a third award of a third desired number of credits, wherein the third desired number of credits is the product of the first desired number of credits times the second multiple.

2. The method of conducting the wagering game of claim 1, wherein each of the first multiple and the second multiple are prime numbers greater than 1.

3. The method of conducting the wagering game of claim 1, including the additional steps of:
(A) initiating a fourth bonus at a third multiple of the preselected number of plays, wherein the third multiple is a number greater than 1; and
(B) providing a fourth award of a fourth desired number of credits, wherein the fourth desired number of credits is the product of the first desired number of credits times the third multiple.

4. The method of conducting the wagering game of claim 1, wherein the method includes the step of providing a video gaming system.

5. The method of conducting the wagering game of claim 4, wherein the step of providing the video gaming system includes providing a video gaming system that plays a game selected from the group of slots, keno, poker, blackjack and bingo.

6. A method of conducting a wagering game, comprising:
(A) conducting a basic game having a randomly selected outcome that is indicated by displaying selected ones of a plurality of basic-game symbols;
(B) initiating a first bonus at a preselected number of plays;
(C) providing a first award of a first desired number of credits;
(D) initiating a second bonus at two times the preselected number of plays;
(E) providing a second award of double the first desired number of credits;
(F) initiating a third bonus at three times the preselected number of plays; and
(G) providing a third award of a third desired number of credits, wherein the third desired number of credits is triple the first desired number of credits.

7. The method of conducting the wagering game of claim 6, including the additional steps of:
(A) initiating a fourth bonus at four times the preselected number of plays; and
(B) providing a fourth award of a fourth desired number of credits, wherein the fourth desired number of credits is the product of four times the first desired number of credits.

8. The method of conducting the wagering game of claim 6, wherein the method includes the step of providing a video gaming system.

9. The method of conducting the wagering game of claim 8, wherein the step of providing the video gaming system includes providing a video gaming system that plays a game selected from the group of slots, keno, poker, blackjack and bingo.

10. A method of conducting a wagering game, comprising:
(A) conducting a basic game having a randomly selected outcome that is indicated by displaying selected ones of a plurality of basic-game symbols;
(B) initiating a first bonus game at a preselected number of plays;
(C) providing a first award of a first desired number of credits upon winning the bonus game;
(D) initiating a second bonus game at a first multiple of the preselected number of plays, wherein the first multiple is a number greater than 1;
(E) providing a second award of a second desired number of credits upon winning the second bonus game, wherein the second desired number of credits is the product of the first desired number of credits times the first multiple;
(F) initiating a third bonus game at a second multiple of the preselected number of plays, wherein the second multiple is a number greater than 1; and
(G) providing a third award of a third desired number of credits upon winning the third bonus game, wherein the third desired number of credits is the product of the first desired number of credits times the second multiple.

11. The method of conducting the wagering game of claim 10, wherein each of the first multiple and the second multiple are prime numbers greater than 1.

12. The method of conducting the wagering game of claim 10, including the additional steps of:
(A) initiating a fourth bonus game at a third multiple of the preselected number of plays, wherein the third multiple is a number greater than 1; and (B) providing a fourth award of a fourth desired number of credits upon winning the fourth bonus game, wherein the fourth desired number of credits is the product of the first desired number of credits times the third multiple.

13. The method of conducting the wagering game of claim 10, wherein the method includes the step of providing a video gaming system.

14. The method of conducting the wagering game of claim 13, wherein the step of providing the video gaming system includes providing a video gaming system that plays a game selected from the group of slots, keno, poker, blackjack and bingo.

15. A method of conducting a wagering game, comprising:

(A) conducting a basic game having a randomly selected outcome that is indicated by displaying selected ones of a plurality of basic-game symbols;

(B) initiating a first bonus game at a preselected number of plays;

(C) providing a first award of a first desired number of credits upon winning the first bonus game;

(D) initiating a second bonus game at two times the preselected number of plays;

(E) providing a second award of double the first desired number of credits upon winning the second bonus game;

(F) initiating a third bonus game at three times the preselected number of plays; and (G) providing a third award of three times the first desired number of credits upon winning the third bonus game.

16. The method of conducting the wagering game of claim 15, including the additional steps of:

(A) initiating a fourth bonus game at four times the preselected number of plays; and (B) providing a fourth award of four times the first desired number of credits upon winning the fourth bonus game.

17. The method of conducting the wagering game of claim 15, wherein the method includes the step of providing a video gaming system.

18. The method of conducting the wagering game of claim 17, wherein the step of providing the video gaming system includes providing a video gaming system that plays a game selected from the group of slots, keno, poker, blackjack and bingo.

19. A method of conducting a wagering game, comprising:

(A) conducting a basic game having a randomly selected outcome that is indicated by displaying selected ones of a plurality of basic-game symbols;

(B) initiating a first bonus upon obtaining a combination of symbols that have odds of occurring at a preselected number of plays;

(C) providing a first award of a first desired number of credits;

(D) initiating a second bonus upon obtaining a combination of symbols that have odds of occurring at a first multiple of the preselected number of plays, wherein the first multiple is a number greater than 1;

(E) providing a second award of a second desired number of credits, wherein the second desired number of credits is the product of the first desired number of credits times the first multiple;

(F) initiating a third bonus upon obtaining a combination of symbols that have odds of occurring at a second multiple of the preselected number of plays, wherein the second multiple is a number greater than 1; and (G) providing a third award of a third desired number of credits, wherein the third desired number of credits is the product of the first desired number of credits times the second multiple.

20. The method of conducting the wagering game of claim 19, wherein each of the first multiple and the second multiple are prime numbers greater than 1.

21. A method of conducting a wagering game, comprising:

(A) conducting a basic game having a randomly selected outcome that is indicated by displaying selected ones of a plurality of basic-game symbols;

(B) initiating a first bonus game upon obtaining a combination of symbols that have odds of occurring at a preselected number of plays;

(C) providing a first award of a first desired number of credits upon winning the bonus game;

(D) initiating a second bonus game upon obtaining a combination of symbols that have odds of occurring at a first multiple of the preselected number of plays, wherein the first multiple is a number greater than 1;

(E) providing a second award of a second desired number of credits upon winning the second bonus game, wherein the second desired number of credits is the product of the first desired number of credits times the first multiple;

(F) initiating a third bonus game upon obtaining a combination of symbols that have odds of occurring at a second multiple of the preselected number of plays, wherein the second multiple is a number greater than 1; and (G) providing a third award of a third desired number of credits upon winning the third bonus game, wherein the third desired number of credits is the product of the first desired number of credits times the second multiple.

22. The method of conducting the wagering game of claim 21, wherein each of the first multiple and the second multiple are prime numbers greater than 1.

23. A method of conducting a wagering game, comprising:

(A) conducting a basic game having a randomly selected outcome that is indicated by displaying selected ones of a plurality of basic-game symbols;

(B) initiating a first bonus game upon obtaining a combination of symbols that have odds of occurring at a preselected number of plays;

(C) providing a first award of a first desired number of credits upon winning the first bonus game;

(D) initiating a second bonus game upon obtaining a combination of symbols that have odds of occurring at two times the preselected number of plays;

(E) providing a second award of double the first desired number of credits upon winning the second bonus game;

(F) initiating a third bonus game upon obtaining a combination of symbols that have odds of occurring at three times the preselected number of plays; and (G) providing a third award of three times the first desired number of credits upon winning the third bonus game.

* * * * *